US005864206A

United States Patent [19]

Ishihara et al.

[11] Patent Number: 5,864,206

[45] Date of Patent: Jan. 26, 1999

[54] ELECTROLUMINESCENT DISPLAY HAVING IMPROVED BREAKDOWN CHARACTERISTICS

[75] Inventors: Hajime Ishihara, Nagoya; Kazuhiro Inoguchi, Toyota; Nobuei Ito, Chiryu; Tadashi Hattori, Okazaki, all of Japan

[73] Assignee: Nippondenso Co., LTD., Kariya, Japan

[21] Appl. No.: 845,388

[22] Filed: Apr. 26, 1997

Related U.S. Application Data

[62] Division of Ser. No. 413,371, Mar. 30, 1995, Pat. No. 5,632,663.

[30] Foreign Application Priority Data

Mar. 31, 1994 [JP] Japan ..... 6-87664

[51] Int. Cl.[6] ..... H05B 33/00

[52] U.S. Cl. ..... 313/506; 313/509; 313/512; 313/323

[58] Field of Search ..... 313/505, 506, 313/509, 512, 232

[56] References Cited

U.S. PATENT DOCUMENTS

| | | | |
|---|---|---|---|
| 4,213,074 | 7/1980 | Kawaguchi et al. | 313/509 |
| 4,357,557 | 11/1982 | Inohara et al. | 313/509 |
| 4,829,213 | 5/1989 | Pepcile et al. | 313/509 |
| 4,954,746 | 9/1990 | Taniguchi et al. | 313/506 |
| 5,124,204 | 6/1992 | Yamashita et al. | 428/331 |

*Primary Examiner*—Sandra O'Shea
*Assistant Examiner*—Matthew J. Gerike
*Attorney, Agent, or Firm*—Pilsbury Madison & sutro LLP

[57] ABSTRACT

An electroluminescent display in which a dielectric breakdown of a luminescent element is suppressed has luminescent elements disposed between first and second substrates, where the first and second substrates are deformed into a convex shape to improve breakdown characteristics.

17 Claims, 4 Drawing Sheets

ELECTROLUMINESCENT DISPLAY HAVING IMPROVED BREAKDOWN CHARACTERISTICS

This is a division of Application Ser. No. 08/413,371, filed Mar. 30, 1995, now U.S. Pat. No. 5,632,663.

CROSS-REFERENCE TO RELATED APPLICATIONS

This application is related to and claims priority under 35 U.S.C. §119 from Japanese Patent Applications No. Hei. 6-87664 and Hei. 7-17073, the contents of which are incorporated herein by reference.

BACKGROUND OF THE INVENTION

1. Field of the Invention

The present invention relates to an electroluminescent display (hereinafter referred to as an "EL display") used, for example, for an indicator mounted in cars and for a display unit of information processing equipment.

2. Description of the Related Art

An EL display generally utilizes a phenomenon in which light is emitted when an electric field is applied to a phosphor such as zinc sulfide. A typical EL display is constructed by forming a luminescent element comprising an optically transparent first transparent electrode, a first insulating layer, a luminescent layer, a second insulating layer and an optically transparent second transparent electrode laminated sequentially on a glass substrate on the display side and disposing a back glass substrate above the second transparent electrode on the glass substrate to cover the luminescent element and by sealing an internal space created between the back glass substrate and the display side glass substrate (see, for example, U.S. Pat. No. 4,213,074).

However, the EL display constructed as described above may suffer from a dielectric breakdown in the luminescent element. Although sometimes the breakdown is only a small breakdown, the breakdown may be propagated starting as a small breakdown and which grows to cover the whole luminescent element. If the breakdown advances to the whole luminescent element as such, the function as the EL display will be impaired.

According to the afore-mentioned U.S. Pat. No. 4,213,074, a container containing silicon oil is stored within a vacuum chamber and a main body of an EL display in which two glass substrates are disposed facing each other is also stored in the vacuum chamber. Then, the inside of the vacuum chamber is evacuated to create a vacuum in the internal space within the EL display. Thereafter, the vacuum chamber is returned to atmospheric pressure while immersing an inlet on the EL display in silicon oil in the container. The silicon oil is injected to the internal space in the EL display by the differential air pressure at this time. The inlet is then sealed.

When the inside of the vacuum chamber is evacuated to create a vacuum in the internal space in the EL display, the two glass substrates of the EL display are deformed into a concave shape denting toward the internal space.

As used hereafter, the term "concave" when used to describe the substrates means that the substrates curve towards the internal space of the display, thereby forming a recess or depression on the external surface thereof. Similarly, "convex" means that the substrates curve outwardly and away from the internal space of the display, thereby forming a bulge on the external surface thereof.

Due to the above phenomenon, the efficiency for injecting the silicon oil drops and the two glass substrates of the EL display are maintained in a concave shape.

Once the glass substrates are deformed into such a concave shape, they attempt to return to their original shape and an inward force acts inside of the glass substrates. The same applies also to the case when the luminescent element is formed on the glass substrate and an inward force, i.e., a compression stress, acts on the luminescent element because the thickness of the luminescent element is very thin in comparison with the glass substrate. When a small dielectric breakdown occurs in the luminescent element in this state, a sectional profile of the breakdown point, i.e., a pinhole, becomes vaselike in the direction of thickness of the luminescent element and the diameter thereof on the opening side (the second electrode side) becomes smaller as compared to that on the bottom side (the first electrode side), because the compression stress, i.e., a contracting force, acts on the luminescent element. This brings about a state where the first insulating layer and second insulating layer as dielectrics do not exist between the first transparent electrode and the second transparent electrode and a current continuously flows around the pinhole, thereby advancing the breakdown. Then, when this breakdown propagates over the whole luminescent element, the functionality of the luminescent element is lost. The dielectric breakdown of the luminescent element here refers to a dielectric breakdown in general in each of the insulating layers and luminescent layer. Accordingly, it is an object of the present invention to suppress the dielectric breakdown of the luminescent element.

SUMMARY OF THE INVENTION

The present invention achieves this and other objects by providing an electroluminescent display comprising a first substrate; a luminescent element comprising a first electrode, a first insulating layer, a luminescent layer, a second insulating layer and a second electrode laminated in that order on the first substrate; a second substrate disposed above the luminescent element via a gap and facing the first substrate to form an internal space between the two substrates; and a sealing section for sealing the internal space from outside and an insulating fluid filling the internal space, where the first and second substrates are deformed into a convex shape.

Further, another luminescent element comprising a first electrode, a first insulating layer, a luminescent layer, a second insulating layer and a second electrode laminated in that order may be formed on the second substrate.

Still further, the radius of curvature R at the center of the first and second substrates is preferably set within a range of $50\ m \leqq R \leqq 1500\ m$.

Yet further, the sealing section may be disposed between the outside of a luminescent area of the luminescent element of the first substrate and a region on the second substrate facing the outside of the luminescent area, and spacers whose tops exceed the height of the sealing section may be disposed between the gap between the luminescent element and the second substrate.

Moreover, a ratio between the height T of the spacer from the first substrate to the top thereof and the height t of the sealing section, T/t, is preferably set within a range of $1.01 \leqq T/t \leqq 1.3$. Also, the first substrate and the second substrate may be transparent.

In another aspect, the present invention comprises the steps of preparing a first substrate on which a luminescent element comprising a first electrode, a first insulating layer, a luminescent layer, a second insulating layer and a second electrode laminated in that order is formed; preparing a second substrate facing the first substrate to cover the luminescent element, for sealing the luminescent element between the two substrates; forming a sealing section between the outside of a luminescent area of the luminescent element of the first substrate and a region on the second substrate facing the outside of the luminescent area while having an inlet for filling an insulating fluid in an internal space created between the first substrate and the second substrate and sealing the internal space from the outside using the sealing section; and injecting the insulating fluid into the internal space from the inlet by utilizing a pressure higher than a pressure of the environment in which the first substrate and the second substrate are placed and thereby deforming the first substrate and the second substrate into a convex shape.

Yet another aspect of the present invention comprises the steps of preparing a first substrate on which a luminescent element comprising a first electrode, a first insulating layer, a luminescent layer, a second insulating layer and a second electrode laminated in that order is formed; preparing a second substrate facing the first substrate for sealing the luminescent element between the two substrates; disposing spacers in a gap between the luminescent element and the second substrate; forming a sealing section between the outside of a luminescent area of the luminescent element of the first substrate and a region on the second substrate facing the outside of the luminescent area while having an inlet for filling an insulating fluid in an internal space created between the first substrate and the second substrate; relatively pressurizing the first substrate and the second substrate to seal the internal space from the outside using the sealing section and to deform the first substrate and the second substrate into a convex shape; and injecting the insulating fluid into the internal space from the inlet.

This aspect of the present invention may additionally include the steps of disposing the first substrate and the second substrate within a vacuum chamber after sealing them using the sealing section; evacuating the vacuum chamber to create a vacuum in the internal space between both substrates via the inlet; connecting the inlet to a container containing the insulating fluid after the vacuuming process; and returning the vacuum chamber to atmospheric pressure to inject the insulating fluid into the internal space.

It is also possible that the height of the spacer from the top thereof to the first substrate is set be higher than that of the sealing section and that the first substrate and the second substrate are deformed into a convex shape. Further, it is possible that an injection pressure P of the insulating fluid is adjusted within a range of $0.75<P<2$ kg/cm$^2$.

Still another aspect of the present invention comprises the steps of preparing a first substrate on which a luminescent element comprising a first electrode, a first insulating layer, a luminescent layer, a second insulating layer and a second electrode laminated in that order is formed; preparing a second substrate facing the first substrate to seal the luminescent element between the two substrates; forming a sealing section between the outside of a luminescent area of the luminescent element of the first substrate and a region on the second substrate facing the outside of the luminescent area while having an inlet for filling an insulating fluid in an internal space created between the first substrate and the second substrate and sealing the internal space from the outside using the sealing section; setting an environment in which the first substrate and the second substrate and the internal space are subjected to a negative pressure; and injecting the insulating fluid into the internal space from the inlet by utilizing a pressure higher than the negative pressure while maintaining the environment in which the first substrate and the second substrate are placed and the internal space at the negative pressure and thereby deforming the first substrate and the second substrate into a convex shape.

Another aspect of the present invention comprises the steps of preparing a first substrate on which a first luminescent element comprising a first electrode, a first insulating layer, a luminescent layer, a second insulating layer and a second electrode laminated in that order is formed; preparing a second substrate on which a second luminescent element comprising a first electrode, a first insulating layer, a luminescent layer, a second insulating layer and a second electrode laminated in that order is formed; forming at least one opening which communicates with an internal space created between the first substrate and the second substrate either on the first substrate or second substrate; disposing the first substrate and the second substrate facing each other so that the first luminescent element and second luminescent element are positioned therebetween; forming a sealing section between the outside of a luminescent area of the luminescent element of the first substrate and a region on the second substrate facing the outside of the luminescent area and sealing the internal space from the outside by the sealing section; and injecting insulating fluid into the internal space from the opening to thereby deform the first substrate and the second substrate into a convex shape, where the opening is formed in advance before the first luminescent element or second luminescent element is formed on the first substrate or second substrate.

As above, it is possible that the first substrate and the second substrate are transparent.

Thus, according to one aspect of the present invention, because the first substrate and second substrate are constructed to deform into a convex shape and the first substrate returns to the original state, an outward force acts inside of the first substrate and an inward force acts outside the same. The same forces act also when the luminescent element is formed on the first substrate and an outward force, i.e., a tensile stress, acts on the luminescent element because the luminescent element is very thin. When a small dielectric breakdown occurs on the luminescent element in this state, the sectional profile of the pinhole at that breakdown point becomes wedged in the thickness direction of the luminescent element and the diameter of the opening side of the pinhole (i.e., the second electrode side) is large in comparison with the diameter of the bottom side thereof (i.e., the first electrode side). Due to that, the first and second insulating layers always exist between the first electrode and the second electrode, no current flows to the breakdown point and the dielectric breakdown is restricted to a small breakdown site. Accordingly, large-scale dielectric breakdown of the luminescent element may be prevented from occurring.

If the other substrate on which the luminescent element is not formed is flat without deformation or is deformed into a concave shape, for example, the substrate on which the luminescent element is formed is deformed into a concave shape when an external force acting on the substrate on which the luminescent element is formed toward the internal side is added.

However, when the first substrate and second substrate are deformed into a convex shape, the substrates will not be deformed into the concave shape because they resist against such external force as described above even if it is added to the substrate on which the luminescent element is formed by being influenced by the distribution of internal pressure in the internal space.

According to the above, the deformation of the first substrate and second substrate described above can be reliably achieved. Also as described above, methods for reliably achieving the deformation of the first substrate and second substrate described above are given.

Further, the existence of the spacers permits deformation of the first substrate and second substrate as described above before the insulating fluid is injected into the internal space. Due to that, it is possible to prevent the first substrate and second substrate from being deformed into a concave shape when the insulating fluid is injected to the internal space.

Further, the insulating fluid is injected into the internal space by utilizing a pressure higher than that of the environment in which the first substrate and second substrate are placed while maintaining the environment at a negative pressure, so that the first substrate and second substrate will not deform into a concave shape. Also, the efficiency of injecting the insulating fluid may be improved.

Moreover, the opening for injecting the insulating fluid is created on either substrate in advance before the luminescent element is formed on the first substrate, so that the strain of the luminescent element along the creation of the opening may be prevented and breakdown of the luminescent element caused by the strain may be avoided.

DETAILED DESCRIPTION OF PREFERRED EMBODIMENTS

The present invention will be explained in detail based on preferred embodiments thereof.

Figure 1:
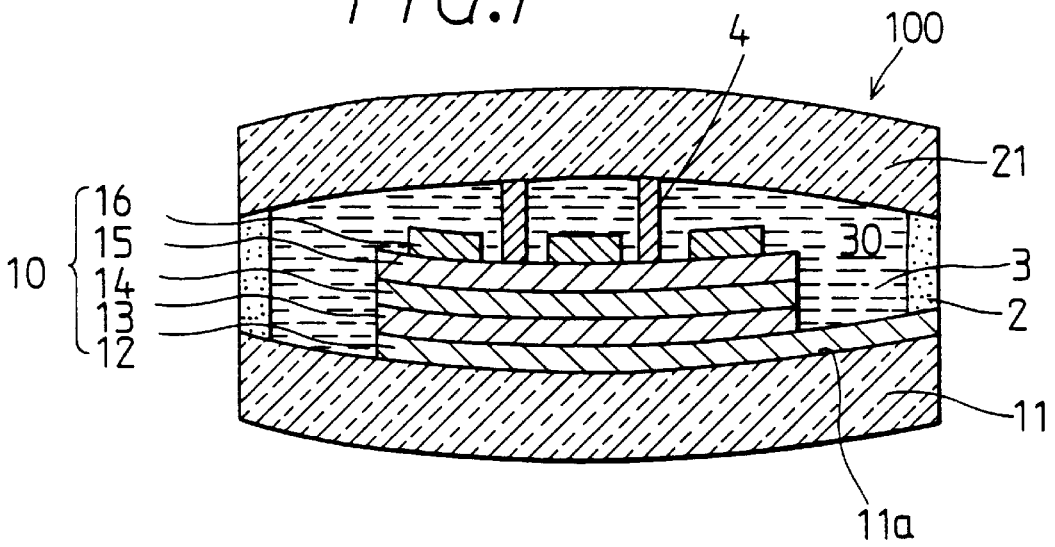
FIG. 1 is a cross-sectional view illustrating a structure of an EL display according to a first preferred embodiment of the present invention.

FIG. 1 is a schematic drawing illustrating a cross-sectional structure of an EL display 100 according to a first embodiment of the present invention. The EL display 100 has an optically transparent glass substrate 11 as an insulating first substrate, and an optically transparent glass substrate 21 as a second substrate. A first luminescent element 10 is formed on a surface 11*a* of the glass substrate 11.

The luminescent element 10 is constructed as follows. A first transparent electrode 12 which is mainly made of optically transparent zinc oxide (ZnO) is formed on the surface 11*a* of the glass substrate 11, and on that, a first insulating layer 13 made of optically transparent tantalum pentoxide ($T_2O_5$), a luminescent layer 14 in which a luminescent central element of manganese, for example, is doped into a base material made of zinc sulfide, a second insulating layer 15 made of optically transparent tantalum pentoxide and a second transparent electrode 16 made of optically transparent zinc oxide are formed.

Facing the glass substrate 11 on which the luminescent element 10 has been formed, a glass substrate 21 is disposed above the luminescent element 10 to cover it via a gap. The glass substrate 21 and the glass substrate 11 are bonded together and sealed by a side wall 2 or sealing section made of a resinous adhesive. The side wall 2 is located between the outside of the luminescent area of the luminescent element 10 on the glass substrate 11 and a region of the glass substrate 21 facing thereto.

An internal space 30 is created between the glass substrate 11 and the glass substrate 21 as they are bonded and sealed by using the side wall 2. Within the internal space 30, a plurality of globular spacers 4 made of resin beads such as micro-pearl and having a diameter of 50 $\mu$m are disposed between the second insulating layer 15 of the luminescent element 10 on the glass substrate 11 and the inner surface of the glass substrate 21. Silicon oil 3, which is one example of an insulating fluid suitable for use in the present invention, fills the internal space 30 to prevent moisture from entering the internal space 30.

The spacers 4 are disposed to prevent the gap between the glass substrate 11 and the glass substrate 21 from becoming narrow. Thus, the glass substrate 11 and the glass substrate 21 are deformed into a convex shape.

It should be noted that because FIG. 1 is a figure reduced in the lateral direction and enlarged in the vertical direction, the represented shape of the spacers 4 is not to scale and the deformed shape of the glass substrates 11 and 21 are also not to scale.

Next, a method of manufacturing the EL display 100 according to the first embodiment will be explained below.

Firstly, the first transparent electrode 12 is formed on the glass substrate 11, where the substrate has a thickness of about 1.1 mm. Gallium oxide ($Ga_2O_3$) powder added to and blended with ZnO powder and formed into pellets is used as a deposition material, and an ion plating unit is used as a film forming apparatus.

More specifically, the ion plating unit is evacuated to a vacuum while keeping the glass substrate 11 at a constant temperature. After that, argon gas (Ar) is introduced to keep a constant pressure to adjust the ion beam power and high frequency power.

Next, the first insulating layer 13 made of $Ta_2O_5$ is formed on the first transparent electrode 12 by sputtering.

More specifically, the deposition sputtering is carried out using high frequency power by keeping the glass substrate 11 at a constant temperature, by maintaining the sputtering unit at a constant pressure and by introducing a mixed gas of Ar and oxygen ($O_2$) into the unit.

Next, the luminescent layer 14 made of a mixture of zinc sulfide (ZnS) and terbium trifluoride ($TbF_3$) in which terbium trifluoride as the center of luminescence is doped to zinc sulfide as the base material, is formed on the first insulating layer 13 by sputtering.

More specifically, the sputtering is carried out using high frequency power by keeping the glass substrate 11 at a constant temperature and by introducing a mixed gas of Ar and helium (He) into the sputtering unit to maintain the sputtering unit at a constant pressure.

After that, heat is applied at 500° C. for four hours in the vacuum to improve the crystallinity of the luminescent layer 14.

After that, the second insulating layer 15 made of $Ta_2O_5$ is formed on the luminescent layer 14 in the same manner as the first insulating layer 13. Then, the second transparent electrode 16 made of ZnO is formed in the same manner as the first transparent electrode 12.

Figure 2:
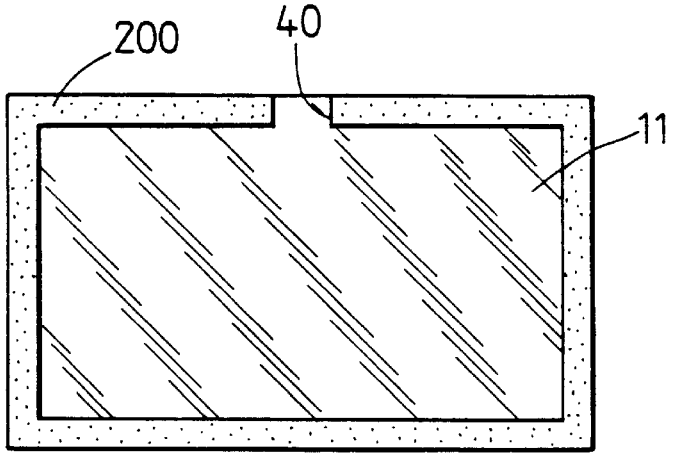
FIG. 2 is a plan view of a glass substrate having a side wall formed for sealing according to the present invention.

As shown in FIG. 2, an adhesive 200 is applied to the periphery of the glass substrate 11 which is the outside of the luminescent area of the luminescent element 10, leaving only an inlet 40.

Next, the glass substrates 21 and 11 are laminated so that the surface 11*a* for forming the element is at the interior while interposing the plurality of spacers 4 made of globular resin beads having a diameter of 50 $\mu$m between the second insulating layer 15 and the glass substrate 21. The glass substrate 21 has the same thickness as the glass substrate 11.

Figure 3:
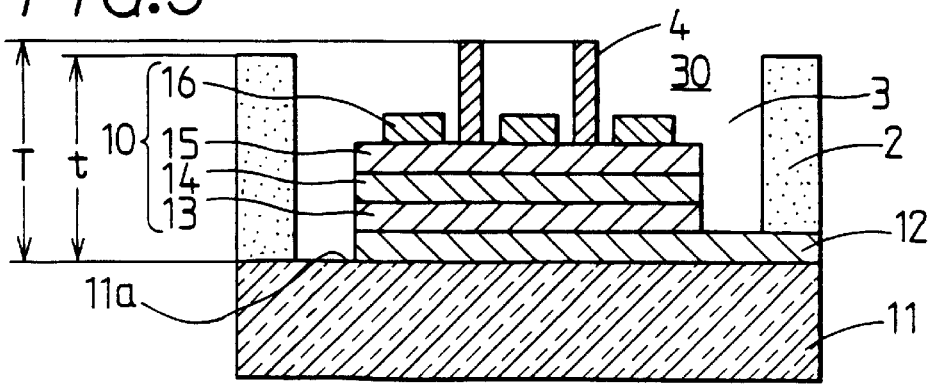
FIG. 3 is a cross-sectional view illustrating a relationship between a height of the side wall and that of the spacers.

As shown in FIG. 3, the distance T from the top of the spacers 4 to the surface 11*a* on the glass substrate 11 is set to be higher than the height t from the top of the adhesive to the surface 11*a* on the glass substrate.

Then, the both glass substrates 21 and 11 are bonded while pressurizing them by a jig so that the glass substrate 21 and the glass substrate 11 are deformed into the convex shape where there is no such internal space by the existence of the spacers 4.

Next, the EL display constructed as described above and a container filled with silicon oil 3 are disposed within a vacuum chamber. After evacuating the vacuum chamber to create a vacuum, the inlet 40 of the EL display is immersed in the silicon oil 3 and then the vacuum chamber is returned to atmospheric pressure. Thereby, because the pressure in the internal space 30 of the EL display becomes lower than that of the outside environment, the silicon oil 3 is drawn into the internal space 30 via the inlet 40.

It should be noted that when the silicon oil 3 fills the internal space 30 by the method described above and when no spacer 4 is inserted in the internal space 30, the glass substrates 11 and 21 are deformed into a concave shape when the pressure in the internal space 30 becomes smaller than that of the outside as described above.

Furthermore, because the silicon oil 3 is injected only by means of the differential pressure on the outside and inside of the internal space 30, the more the silicon oil 3 is injected, the differential pressure becomes smaller, thereby lowering the injection efficiency of the silicon oil 3. In the end, no silicon oil is injected until the glass substrates 11 and 21 return to the original state completely.

In comparison, because the spacers 4 are interposed between the glass substrate 21 and the luminescent element 10 in the internal space 30 in the first embodiment, no deformation into the concave shape is seen when the silicon oil 3 is injected. Accordingly, it becomes possible to avoid the reduction in injection efficiency of the silicon oil 3.

When the EL display 100 of the first embodiment was caused to emit light and its breakdown state was studied, no breakdown was observed in the luminescent element 10. However, the propagated breakdown by which the breakdown spreads over the whole luminescent element 10 was observed in an EL display in which no spacer 4 was provided.

Next, a graph in which a relationship between the deformation of the glass substrates 11, 21 and the breakdown of the luminescent element 10 was quantitatively observed will be explained.

Figure 4:
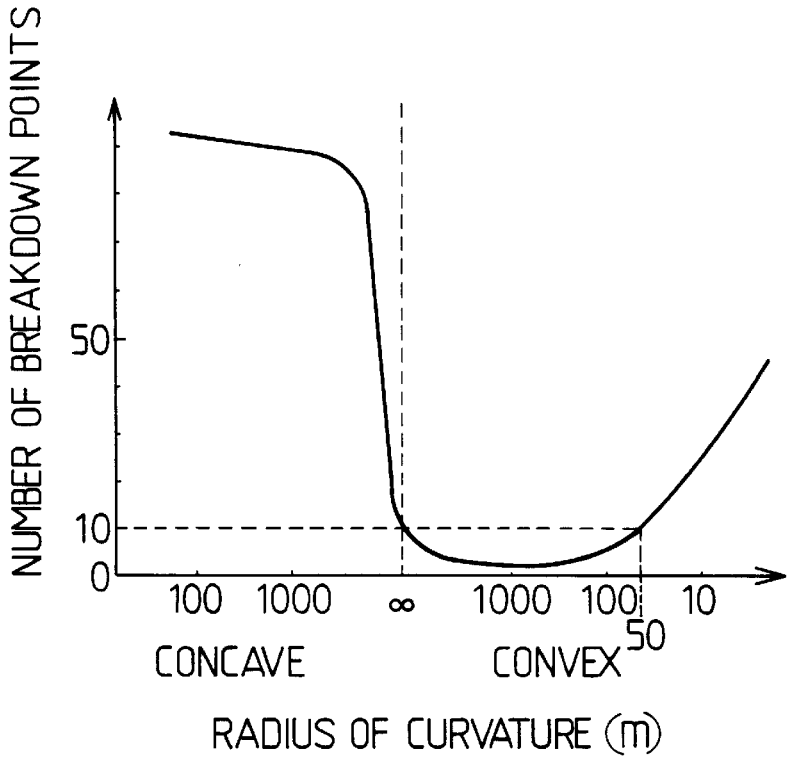
FIG. 4 is a graph showing a relationship between a radius of curvature of a glass substrate and a number of * breakdown points.

FIG. 4 is a graph showing a relationship between a radius of curvature of the glass substrates 11 and 21 and a number of breakdown points of the luminescent element 10. As shown in FIG. 4, there are many breakdown points in the luminescent element when the glass substrates 11 and 21 are bent into a concave shape. In comparison, when the glass substrates 11 and 21 are bent in a convex shape, no breakdown points were seen in the luminescent element 10 until a certain degree of curvature was reached. The number of breakdown points in the luminescent element 10 increases beyond that level. It can be seen that when the convex radius of curvature is more than about 50 m, the number of breakdown points is less than 10.

Figure 5:
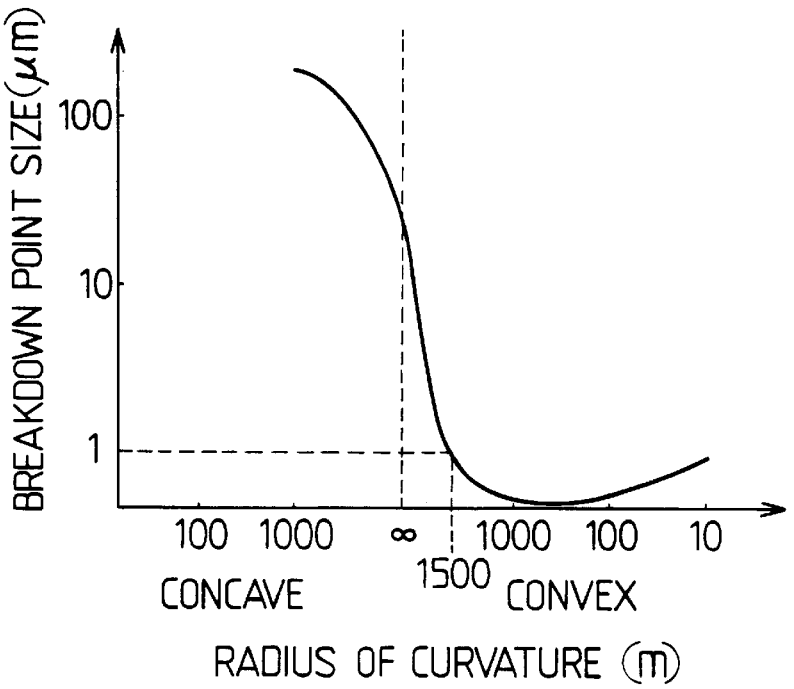
FIG. 5 is a graph showing a relationship between the radius of curvature of the glass substrate and a size of a breakdown point.

FIG. 5 is a graph showing a relationship between the radius of curvature of the glass substrates 11 and 21 and a size of the breakdown point. As shown in FIG. 5, although the size of the breakdown point in the luminescent element is smaller than 1 micron when the convex radius of curvature of the glass substrate is less than 1500 m, causing a self-recovery type breakdown which does not foster the propagation of breakdown points, the breakdown point becomes large when the convex curvature exceeds 1500 m, causing propagation-type breakdown.

That is, there is less likelihood of a breakdown point occurring when the convex radius of curvature of the glass substrate is greater than 50 m and less than 1500 m and even if it does occur, it is a self-recovery type small breakdown point.

Figure 6:
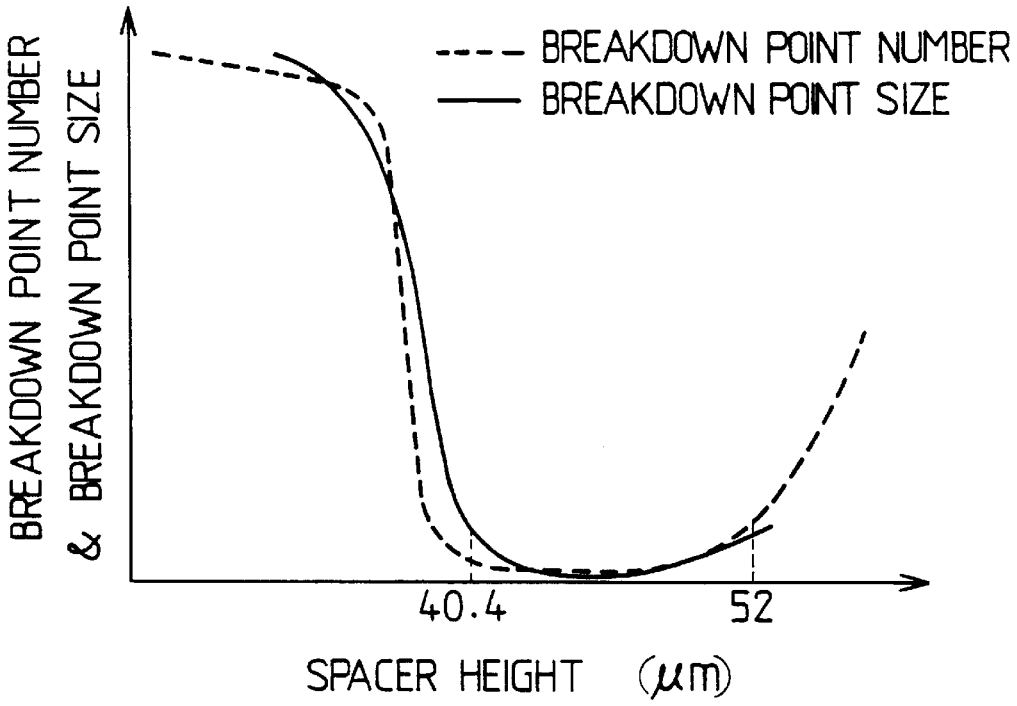
FIG. 6 is a graph showing a relationship between the height of the spacer, the number of breakdown points and the size of the breakdown points.

FIG. 6 is a graph showing changes in the number of breakdown points when the height of the side wall 2 is kept constant and the height of the spacer 4 is changed. This graph shows the same tendency as that of the graph in FIG. 4. That is, assuming a distance between side walls of 70 mm, when a ratio of the height of the spacer 4 to that of the side wall 2 is 1.01, the radius of curvature of the glass substrate is 1500 m, and when it is 1.3, the radius of curvature is 50 m. No propagation-type breakdown was seen in the present embodiment because the diameter of the resin beads as the spacer 4 is 50 $\mu$m and the height of the side wall 2 is 40 $\mu$m and the ratio between the height of the side wall 2 and the diameter of the spacer 4 falls within the above-mentioned range of 1.01–1.3.

Figure 7:
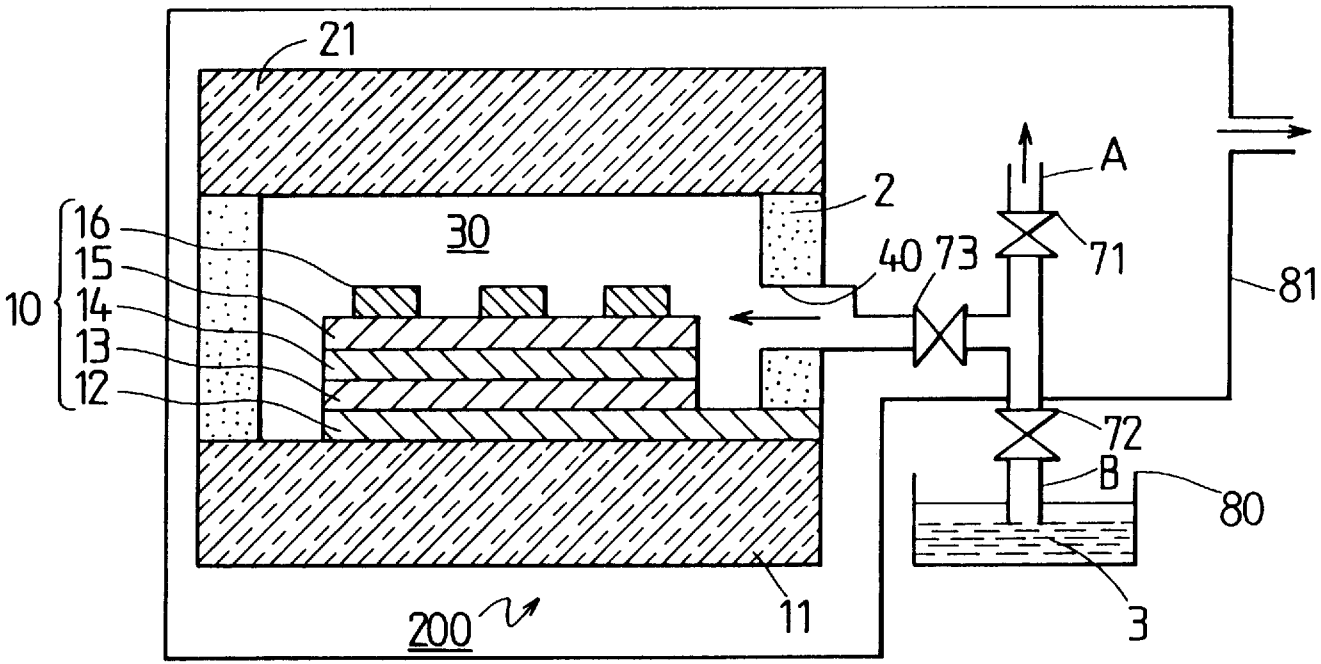
FIG. 7 is a schematic drawing illustrating a manufacturing method of an EL display of another embodiment according to the present invention.

A second embodiment as shown in FIG. 7 is characterized in that the glass substrates 11 and 21 are formed into the convex shape without using the spacer 4 as was done in the first embodiment.

The structure of an EL display 200 according to this embodiment is substantially the same with the EL display 100 in the first embodiment except that there is no spacer 4. As shown in FIG. 7, the inlet 40 is created on the side wall 2. A pipe A for evacuating the internal space 30 and a pipe B for injecting silicon oil 3 are connected to the inlet 40 via a valve 73 and valves 71 and 72 for switching their respective sources. The pipe B is connected to a container 80 filled with silicon oil 3. This EL display 200 is put into a vacuum chamber 81 which is evacuated to a vacuum level and the internal space 30 communicates with the inside of the vacuum chamber 81 via the valves 73, 71 and the pipe A.

The container 80 containing the silicon oil is placed outside of the vacuum chamber 81 and atmospheric pressure is applied on the liquid surface of the silicon oil 3. When the inlet 40 is connected to the pipe A by opening the valves 71 and 73 and closing the valve 72 and then the vacuum chamber 81 is evacuated, the outside of the EL display 200, i.e., the inside of the vacuum chamber 81, and the internal space 30 are evacuated via the pipe A.

Thereafter, when the inlet 40 is connected to the pipe B by closing the valve 71 and opening the valve 72 while maintaining the vacuum chamber 81 and the internal space 30 near vacuum pressure, the silicon oil 3 contained in the container 80 is injected into the internal space 30 by the difference of pressures of the vacuum pressure in the internal space 30 and the atmospheric pressure, because the atmospheric pressure which is higher than the pressure in the internal space 30 is applied to the liquid surface of the container 80. Afterwards, the inside of the chamber 81 is returned to atmospheric pressure.

In this injection process, because the outside of the glass substrate 11 and the glass substrate 21, i.e., the inside of the vacuum chamber 81, is a vacuum and because the pressure in the internal space 30 becomes higher than when the silicon oil 3 is injected, the glass substrate 11 and the glass substrate 21 will not bend in a concave shape.

Similar to the EL display 100 in the first embodiment, no breakdown was seen in the luminescent element in the EL display 200 fabricated as described above.

Although the container 80 containing the silicon oil 3 has been placed outside of the vacuum chamber 81 in the second embodiment, it is not always necessary to put it outside of the vacuum chamber 81, and it may be put either inside or outside of the vacuum chamber 81 as long as the container 80 is provided with a controller to control the surface pressure of the silicon oil 3.

When the above-mentioned pressure controller is used, the injection efficiency of the silicon oil injected into the internal space 30 may be improved by setting the silicon oil injection pressure P within a range of $0.75<P<2$ kg/cm$^2$.

Figure 8:
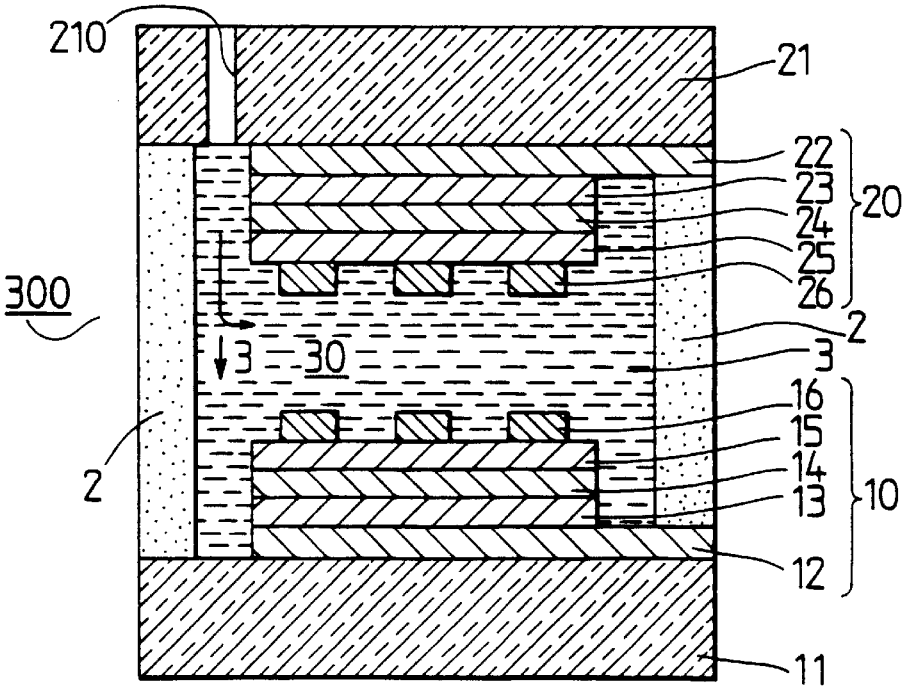
FIG. 8 is a section view illustrating a structure of the EL display of the other embodiment.

A third embodiment relates to a manufacturing method of an EL display 300 as shown in FIG. 8. In the EL display 300, a second luminescent element 20 which has the same structure as the luminescent element 10 of the EL display 100 in the first embodiment shown in FIG. 1 (it emits the same luminescent colored light) is formed also on the glass substrate 21.

In other words, first transparent substrate 22 has a structure similar to that of first transparent substrate 12; first insulating layer 23 has a structure similar to that of first insulating layer 13; the luminescent layer 24 has a structure similar to that of the luminescent layer 14; the second insulating layer 25 has a structure similar to that of second insulating layer 15; and the second transparent electrode 26 has a structure similar to that of second transparent electrode 16.

More specifically, the glass substrate 11 and the glass substrate 21 are bonded and sealed by the side wall 2 formed by the adhesive so that the second electrode 16 of the first luminescent element 10 and a second electrode 26 of the second luminescent element 20 face each other. In the third embodiment, an inlet 210, i.e. an opening, is perforated on the glass substrate 21 in advance before the second luminescent element 20 is formed. Accordingly, the inlet 210 communicates with the internal space 30 in the assembled state as shown in FIG. 8.

It is easy to create the inlet 210 for injecting the silicon oil 3 on the glass substrate 21 of the EL display 100 of the first embodiment shown in FIG. 1 on which the second luminescent element 20 is not formed. However, when the first luminescent element 10 and the second luminescent element 20 are formed respectively on the glass substrate 11 and the glass substrate 21 as shown in FIG. 8, opening the inlet 210 for the silicon oil 3 after forming the luminescent elements 10 and 20 causes deformation of the first and second luminescent element 10 and 20 and causes chips produced when the inlet 210 is machined to adhere on the first and second luminescent elements 10 and 20, thereby causing flaws in the EL display.

Accordingly, an EL display 300 which will not exhibit such breakdown characteristics may be obtained by opening the silicon oil inlet 210 on the glass substrate 21 in advance and by forming a first electrode 22, a first insulating layer 23, a luminescent layer 24, a second insulating layer 25 and a second electrode 26 on the second substrate 21.

The present invention is not confined only to those preferred embodiments described above, and various modifications can be made, for example, as described below.

For example, the present invention is applicable also to an EL display in which more luminescent layers are laminated besides the first and second layers, i.e. an EL display in which three luminescent layers, each emitting an RGB (red, green, blue) color component, for example, are laminated. Such RGB luminescent elements permit realization of a full-color display.

Further, although the two luminescent elements are disposed facing each other in the third embodiment, the two luminescent elements may be disposed in parallel on the same plane of the same substrate. This concept may be applied to the RGB luminescent elements described above or to those luminescent elements emitting two RGB color components.

Although glass substrates have been used for both first and second substrates to make them transparent and to cause them to pass light from the luminescent elements from the both directions of the EL display in the first through third embodiments, it is possible to cause the display to emit light only from one direction by appropriately changing the materials of the first substrate, second substrate, electrodes and insulating layers. For example, the glass substrate may be made opaque in the first embodiment.

Although the second luminescent element formed on the glass substrate emits the same luminescent color with the first luminescent element formed on the glass substrate in the third embodiment, it is of course possible to differentiate the luminescent color of the second luminescent element from that of the first luminescent element.

Although a transparent glass substrate has been used for the glass substrate, the transparent glass substrate may be a glass substrate having, for example, a filter corresponding to an RGB color component, filters combining two RGB component colors or filters of three RGB component colors.

Each filter of RGB for example may be formed above the second electrode of the first luminescent element. Also, although silicon oil has been used as an insulating fluid, an inert gas may be used. Further, the pressure controller used in the second embodiment may be applied also to the first and third embodiments.

Although the present invention has been fully described in connection with the preferred embodiment thereof with reference to the accompanying drawings, it is to be noted that various changes and modifications will become apparent to those skilled in the art. Such changes and modifications are to be understood as being included within the scope of the present invention as defined by the appended claims.

What is claimed is:

1. An electroluminescent display comprising:

a first substrate;

a luminescent element disposed on said first substrate;

a second substrate disposed away from said luminescent element by a predetermined distance, inner surfaces of said first and second substrate thereby defining an internal space between said first and second substrates;

a sealing section sealing said internal space; and an insulating fluid filling said internal space;

wherein said inner surfaces of said first and second substrates are each deformed outwardly away from said internal space to form a concave curvature relative to said internal space.

2. The electroluminescent display of claim 1, said luminescent element comprising:

a first electrode disposed on said first substrate;

a first insulating layer disposed on said first electrode opposite said first substrate;

a luminescent layer disposed on said first insulating layer opposite said first electrode;

a second insulating layer disposed on said luminescent layer opposite said first insulating layer; and a second electrode disposed on said second insulating layer opposite said luminescent layer.

3. The electroluminescent display of claim 1, further comprising an additional luminescent element disposed on said second substrate.

4. The electroluminescent display of claim 3, said additional luminescent element comprising:

a first electrode disposed on said second substrate;

a first insulating layer disposed on said first electrode opposite said first substrate;

a luminescent layer disposed on said first insulating layer opposite said first electrode;

a second insulating layer disposed on said luminescent layer opposite said first insulating layer; and a second electrode disposed on said second insulating layer opposite said luminescent layer.

5. The electroluminescent display of claim 1, wherein a radius of curvature R corresponding to said concave curvature at a center of each of said first and second substrates is within a range of 50 m$\leqq$R$\leqq$1500 m.

6. The electroluminescent display of claim 1, wherein said sealing section is disposed between a region of said first substrate outside a luminescent area of said luminescent element and a region on said second substrate facing said region outside said luminescent area.

7. The electroluminescent display of claim 1, further comprising spacers, disposed in said internal space, displacing a portion of said first and second substrates away from one another by a distance greater than said predetermined distance to provide said concave shape.

8. The electroluminescent display of claim 7, wherein each of said spacers has a first end contacting one of said substrates.

9. The electroluminescent display of claim 8, wherein each of said spacers has a second end contacting said luminescent element.

10. The electroluminescent display of claim 7, wherein said sealing section separates said first and second substrates from one another by said predetermined distance; and each of said spacers has an end proximate one of said substrates and disposed away from the other of said substrates by a spacing distance greater than said predetermined distance, thereby providing said concave shape.

11. The electroluminescent display of claim 10, wherein a ratio T/t between said spacing distance T and said predetermined distance t is within a range of $1.01 \leqq T/t \leqq 1.3$.

12. The electroluminescent display of claim 1, wherein said first and second substrates are transparent.

13. An electroluminescent display comprising:

a first substrate;

a luminescent element disposed on the first substrate;

a second substrate disposed away from the luminescent element by a predetermined distance;

wherein inner surfaces of the first and second substrates form an internal space;

a sealing section, disposed between the first and second substrates, sealing the internal space and having a predetermined height;

wherein a height between the first and second substrates in a region between sides thereof is set higher than that of the sealing portion, to deform the first and second substrates into a convex shape bulging away from the internal space.

14. The display of claim 13, wherein the luminescent element comprises:

a first electrode disposed on the first substrate;

a first insulating layer disposed on the first electrode opposite the first substrate;

a luminescent layer disposed on the first insulating layer opposite the first electrode;

a second insulating layer disposed on the luminescent layer opposite the first insulating layer; and a second electrode disposed on the second insulating layer opposite the luminescent layer.

15. The display of claim 13, further comprising an additional luminescent element disposed on the second substrate.

16. The display of claim 15, wherein the additional luminescent element comprises:

a first electrode disposed on the second substrate;

a first insulating layer disposed on the first electrode opposite the first substrate;

a luminescent layer disposed on the first insulating layer opposite the first electrode;

a second insulating layer disposed on the luminescent layer opposite the first insulating layer; and a second electrode disposed on the second insulating layer opposite the luminescent layer.

17. The display of claim 13, wherein a radius of curvature R at a center of each of said first and second substrates is within a range of 50 meters$\leqq$R$\leqq$1500 meters.

* * * * *

UNITED STATES PATENT AND TRADEMARK OFFICE

CERTIFICATE OF CORRECTION

PATENT NO. : 5,864,206
DATED : January 26, 1999
INVENTOR(S) : Ishihara et al.

It is certified that error appears in the above-identified patent and that said Letters Patent is hereby corrected as shown below:

On Title Page of the Patent

Please change "[22] Filed: Apr. 26, 1997" to --[22] Filed: April 25, 1997--

Please add: --[30] Foreign Application Priority Data
February 3, 1995 [JP] Japan 7-17073

Signed and Sealed this

Third Day of July, 2001

*Attest:*

Nicholas P. Godici

*Attesting Officer*

NICHOLAS P. GODICI
*Acting Director of the United States Patent and Trademark Office*